US010478844B2

(12) United States Patent
Bauer et al.

(10) Patent No.: US 10,478,844 B2
(45) Date of Patent: Nov. 19, 2019

(54) ERGONOMIC SPRAY ACTUATOR, A SPRAYER COMPRISING THE ERGONOMIC SPRAY ACTUATOR, AND A METHOD OF FRESHENING THE AIR OR FABRIC

(71) Applicant: The Procter & Gamble Company, Cincinnati, OH (US)

(72) Inventors: Matthew Stephen Bauer, Loveland, OH (US); Linda Magenis Girard, Union, KY (US); Laura Lynn Heilman, Petersburg, KY (US); James Alexander Morley, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/945,756

(22) Filed: Apr. 5, 2018

(65) Prior Publication Data

US 2018/0304290 A1 Oct. 25, 2018

Related U.S. Application Data

(60) Provisional application No. 62/487,052, filed on Apr. 19, 2017.

(51) Int. Cl.

| | |
|---|---|
| ***B05B 11/00*** | (2006.01) |
| ***B05B 12/00*** | (2018.01) |
| ***B65D 83/20*** | (2006.01) |

(52) U.S. Cl.

CPC ..... *B05B 11/3057* (2013.01); *B05B 11/3026* (2013.01); *B05B 11/3056* (2013.01); *B05B 11/3073* (2013.01); *B05B 12/002* (2013.01); *B65D 83/201* (2013.01)

(58) Field of Classification Search

CPC ..... B05B 11/3057; B05B 11/3011; B05B 11/3026; B05B 11/3073

See application file for complete search history.

(56) References Cited

U.S. PATENT DOCUMENTS

| | | | | |
|---|---|---|---|---|
| 4,138,039 A | | 2/1979 | Micallef | |
| 4,676,437 A | * | 6/1987 | Brown | B29B 7/7438 239/414 |
| 5,477,988 A | | 12/1995 | Gersch | |
| 5,762,236 A | | 6/1998 | Foster et al. | |
| 6,036,057 A | * | 3/2000 | Poutiatine | B05B 11/0056 222/137 |

(Continued)

FOREIGN PATENT DOCUMENTS

| | | |
|---|---|---|
| EP | 2552805 B1 | 10/2015 |
| WO | WO9726086 A3 | 9/1997 |

OTHER PUBLICATIONS

U.S. Appl. No. 15/945,754, filed Apr. 5, 2018, Bauer, et al.

(Continued)

*Primary Examiner* — Jeremy Carroll
(74) *Attorney, Agent, or Firm* — Abbey A. Lopez

(57) ABSTRACT

An actuator includes a nozzle; a valve; and a trigger operatively connected with the valve, wherein the trigger comprises an elastomeric material, wherein the trigger is configured to reciprocate from a forward position to a rearward position and back to a forward position upon actuation, wherein upon actuation from a forward position to a rearward position the trigger comprises a changing moment arm.

14 Claims, 16 Drawing Sheets

(56) References Cited

U.S. PATENT DOCUMENTS

| | | | | |
|---|---|---|---|---|
| 6,345,776 | B1 * | 2/2002 | Hurray | B05B 12/0024 239/413 |
| 6,431,468 | B1 * | 8/2002 | Brown | B05B 7/1209 239/526 |
| 7,389,949 | B2 * | 6/2008 | Marchand | B05B 9/01 239/526 |
| 2004/0182884 | A1 | 9/2004 | Tada | |

OTHER PUBLICATIONS

Case 14783 PCT Search Report; PCTUS2018/028230; dated Jul. 23, 2018; 15 Pages.
Case 14784 PCT Search Report; PCT US 2018/028231; dated Jul. 23, 2018; 14 Pages.

* cited by examiner

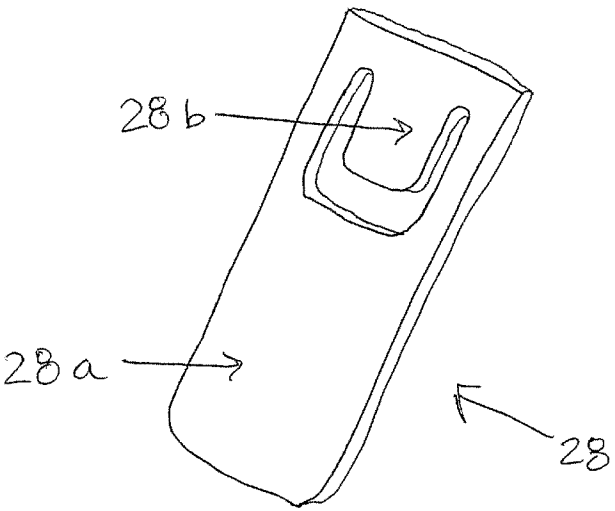
Fig. 16
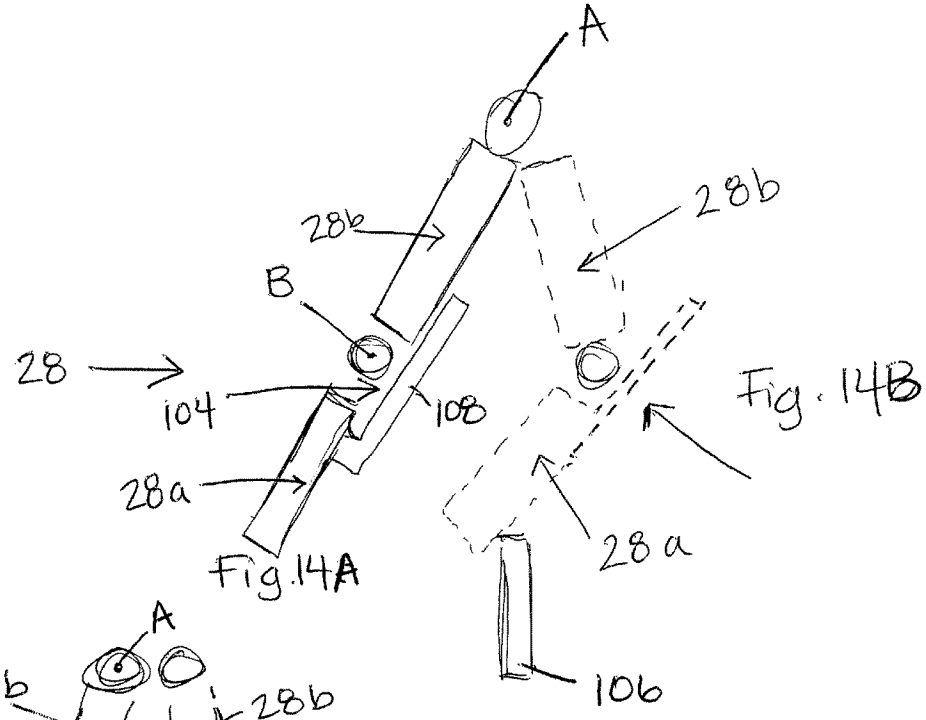
Fig. 14A
Fig. 14B
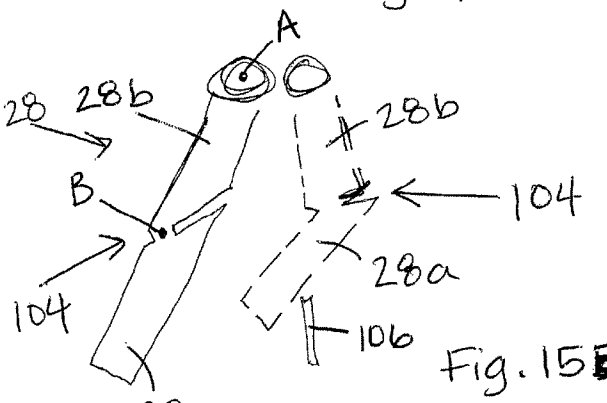
Fig. 15A
Fig. 15B

ERGONOMIC SPRAY ACTUATOR, A SPRAYER COMPRISING THE ERGONOMIC SPRAY ACTUATOR, AND A METHOD OF FRESHENING THE AIR OR FABRIC

FIELD

The present disclosure is directed to an ergonomic spray actuator, a spray product comprising the ergonomic spray actuator, and a method of freshening the air or fabric with the same.

BACKGROUND

Spray products having a trigger are known. Trigger sprayers utilize a handheld container, typically depending from a manual pump or pressurized container. The container may hold any composition desired to be sprayed in a stream, fine droplets, foam or mist. The composition may comprise an air freshener, fabric refresher, hair spray, cleanser, etc.

The pump or valve stem of an aerosol sprayer is activated by an articulating trigger. The user squeezes the trigger with his or her hand, typically retracting the trigger from a forward resting position to a rearward dispensing position. The motion of the trigger causes the composition to be dispensed from the container and sprayed out of a nozzle.

The characteristics of the spray, e.g. stream, droplets, mist, are determined by several parameters and operating characteristics of the pump. For example, the nozzle geometry, piston bore, piston stroke and pump efficiency will all affect the spray characteristics.

The situation is complicated if a pump designed for one particular composition is used with a different composition. The composition rheology, surface tension, etc. also affect the spray characteristics.

The situation is further complicated by user operation. The pump may be designed and intended to be used with full trigger strokes, each stroke dispensing a full volume of the piston displacement at a particular stroke speed. However, the user may not always, or ever, operate the trigger in the intended manner.

If the piston bore is too large, the force necessary to achieve proper trigger stroke may be too great for a particular user. If the piston stroke is too long or if the trigger articulation is too long, the user may not pull the trigger for the entire intended path length. If the user's hand is too small or too large, the user may not operate the trigger as intended. The user may operate the trigger slower or faster than intended. The user's hand may fatigue and operation may change in the middle of a particular usage and even mid-stroke.

Thus, it would be beneficial to provide a spray actuator and spray product that are ergonomically designed for a range of users.

SUMMARY

Combinations:

A. An actuator comprising:
- a nozzle;
- a valve;
- a trigger operatively connected with the valve, wherein the trigger comprises a first zone and a second zone, wherein the first and second zones are joined by a hinge, wherein the hinge comprises a hinge axis that the first and second zones are movable about, wherein the trigger is configured to reciprocate from a forward position to a rearward position and back to a forward position upon actuation; and
- a mechanical stop positioned between the trigger and the housing, wherein the mechanical stop is configured to engage with the first zone of the trigger, wherein movement of the trigger from a forward position to the mechanical stop causes the first and second zones to move about a common axis, wherein movement of the trigger from the mechanical stop to the rearward position causes the first and second zones to move in opposite directions about the hinge axis.

B. The actuator of Paragraph A, wherein the hinge is a living hinge.

C. The actuator of Paragraph A or Paragraph B, wherein the first and second zones are separate elements connected at the hinge.

D. The actuator of any of Paragraphs A through C, wherein the trigger comprises a cover, wherein the cover comprises an elastomeric material that surrounds the first and second zones of the trigger.

E. The actuator of any of Paragraphs A through D, wherein the trigger comprises an elastic coupler that joins the first and second zones.

F. A sprayer comprising the actuator of any of Paragraphs A through D that is operatively connected with a container.

G. The sprayer of Paragraph F further comprising an air freshening composition or a fabric freshening composition.

H. A method of freshening the air or fabric comprising the steps of:
- providing a sprayer of any of Paragraphs A through G;
- spraying the composition into the air or onto a surface.

I. An actuator comprising:
- a nozzle;
- a valve;
- a trigger operatively connected with the valve, wherein the trigger comprises a first zone and a second zone, wherein the first and second zones are connected at a hinge, wherein the trigger is configured to reciprocate from a forward position to a rearward position and back to a forward position upon actuation, wherein applying a force to the hinge in the opposite direction of actuation causes the first and second zones to move in opposite directions about the same axis.

J. The actuator of Paragraph I, wherein the hinge is a living hinge.

K. The actuator of Paragraph I or Paragraph J, wherein the first and second zones are separate elements connected at the hinge.

L. The actuator of any of Paragraphs I through K, wherein the trigger comprises a cover, wherein the cover comprises an elastomeric material that surrounds the first and second zones of the trigger.

M. The actuator of any of Paragraphs I through L, wherein the trigger comprises an elastic coupler that joins the first and second zones.

N. A sprayer comprising the actuator of any of any of Paragraphs I through M that is operatively connected with a container.

O. The sprayer of Paragraph N further comprising an air freshening composition or a fabric freshening composition.

P. A method of freshening the air or fabric comprising the steps of:
- providing a sprayer of any of any of Paragraphs I through O;
- spraying the composition into the air or onto a surface.

Q. An actuator comprising:
a nozzle;
a valve; and
a trigger operatively connected with the valve, wherein the trigger comprises an elastomeric material, wherein the trigger is configured to reciprocate from a forward position to a rearward position and back to a forward position upon actuation, wherein upon actuation from a forward position to a rearward position the trigger comprises a changing moment arm.

R. The actuator of Paragraph Q, wherein the hinge is a living hinge.

S. The actuator of Paragraph Q or Paragraph R, wherein the first and second zones are separate elements connected at the hinge.

T. The actuator of any of Paragraphs Q through S, wherein the trigger comprises a cover, wherein the cover comprises an elastomeric material that surrounds the first and second zones of the trigger.

U. The actuator of any of Paragraphs Q through T, wherein the trigger comprises an elastic coupler that joins the first and second zones.

V. A sprayer comprising the actuator of any of any of Paragraphs Q through U that is operatively connected with a container.

W. The sprayer of Paragraph V further comprising an air freshening composition or a fabric freshening composition.

X. A method of freshening the air or fabric comprising the steps of:
providing a sprayer of any of any of Paragraphs Q through W;
spraying the composition into the air or onto a surface.

Y. An actuator comprising:
a nozzle;
a valve;
a trigger operatively connected with the valve, wherein the trigger comprises an outer surface and a first zone and a second zone, wherein the trigger is adaptable to first and second configurations, wherein in the first configuration the outer surface has a first length, and wherein in the second configuration the outer surface has a second length that is different from the first length.

Z. The actuator of Paragraph Y, wherein the second zone is movable from a first position to a second position, wherein in the first position the outer surface comprises the first zone and the second zone is disposed behind the first zone, and where in in the second position outer surface comprises the first and second zones.

AA. The actuator of Paragraph Y or Paragraph Z, wherein the extension is slideably connected with the first zone of the trigger.

BB. The actuator of any of Paragraphs Y through AA, wherein the extension is rotatably connected with the first zone of the trigger.

CC. The actuator of any of Paragraphs Y through BB, wherein the hinge is a living hinge.

DD. The actuator of any of Paragraphs Y through CC, wherein the first and second zones are separate elements connected at the hinge.

EE. The actuator of any of Paragraphs Y through DD, wherein the trigger comprises a cover, wherein the cover comprises an elastomeric material that surrounds the first and second zones of the trigger.

FF. The actuator of any of Paragraphs Y through EE, wherein the trigger comprises an elastic coupler that joins the first and second zones.

GG. A sprayer comprising the actuator of any of any of Paragraphs Y through FF that is operatively connected with a container.

HH The sprayer of Paragraph GG further comprising an air freshening composition or a fabric freshening composition.

II. A method of freshening the air or fabric comprising the steps of:
providing a sprayer of any of any of Paragraphs Y through HH;
spraying the composition into the air or onto a surface.

BRIEF DESCRIPTION OF THE DRAWINGS

FIG. 14A is a schematic of a side, elevation view of a trigger in a forward position.

FIG. 14B is a schematic of a side, elevation view of a trigger in a rearward position.

FIG. 15A is a schematic of a side, elevation view of a trigger in a forward position.

FIG. 15B is a schematic of a side, elevation view of a trigger in a rearward position.

FIG. 16 is a schematic of a perspective view of a trigger in a forward position.

DETAILED DESCRIPTION

Figure 1:
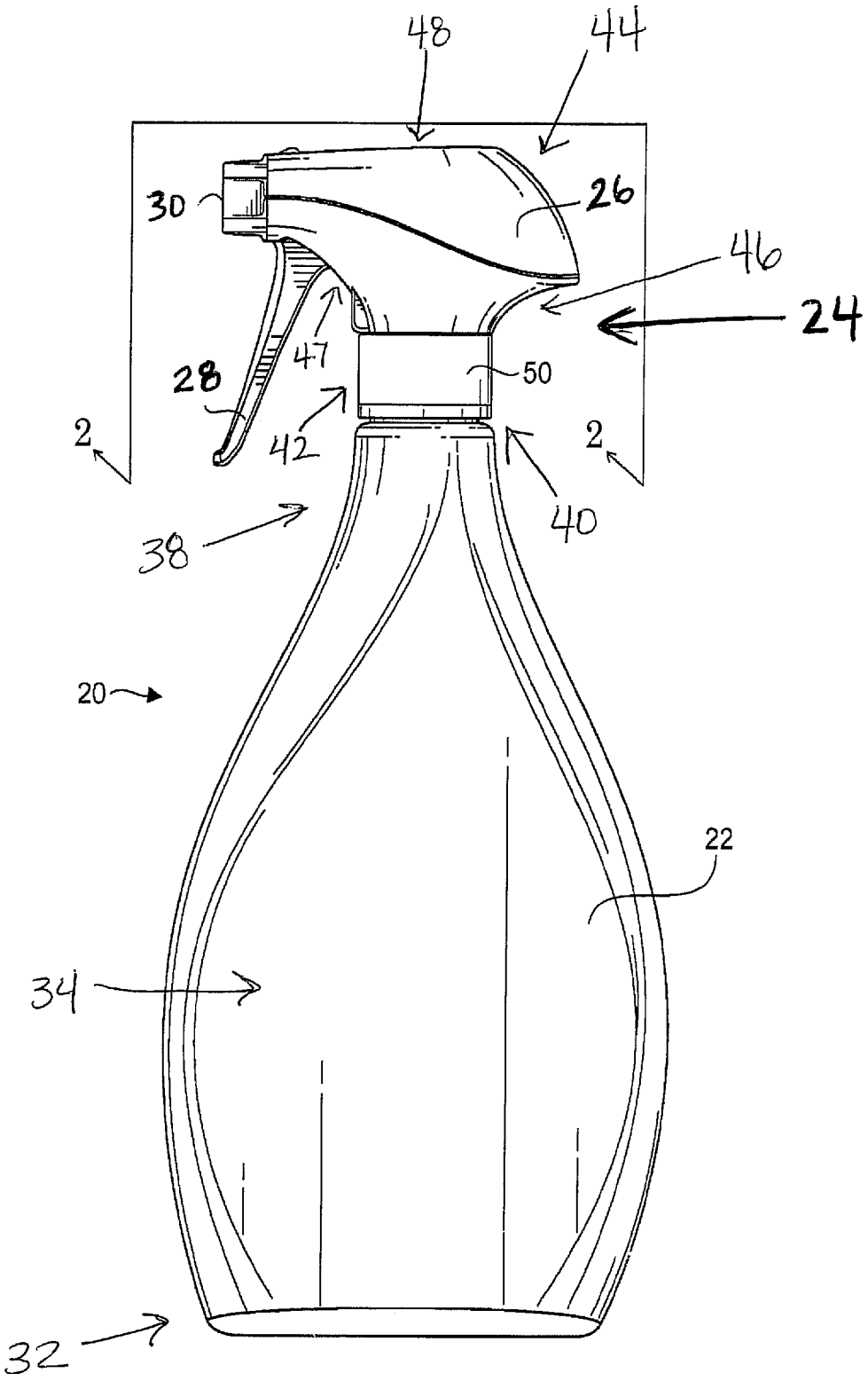
FIG. 1 is a side elevation view of a sprayer.

While the below description describes a sprayer and spray actuator comprising a housing, trigger, nozzle, and container each having various components, it is to be understood that the sprayer is not limited to the construction and arrangement set forth in the following description or illustrated in the drawings. The sprayer, actuator, housing, trigger, nozzle, pump assembly, and container, of the present disclosure are applicable to other configurations or may be practiced or carried out in various ways. For example, the components of the trigger may be used with various pump assemblies for manually-activated trigger sprayers or valve stems of aerosol-type sprayers. Moreover, the trigger and/or pump assembly may be used with various spray actuators for delivering a composition into the air.

The present disclosure relates to a sprayer, a sprayer actuator, and a method of making and using the same. FIGS. 1-11 shows one non-limiting embodiment of a sprayer 20. As shown in FIG. 1, the sprayer 20 comprises a container 22 and a sprayer actuator (or "actuator") 24. The sprayer actuator 24 comprises a housing 26, a trigger 28, and a nozzle 30. The sprayer 20 can be a pressurized container sprayer, such as an aerosol sprayer, or a non-aerosol manually-actuated trigger sprayer, or any other suitable type of sprayer which can benefit from the features described herein. The sprayer 20 and spray actuator 24 may have a longitudinal axis, which is parallel to a portion of the fluid flow during dispensing.

Figure 7:
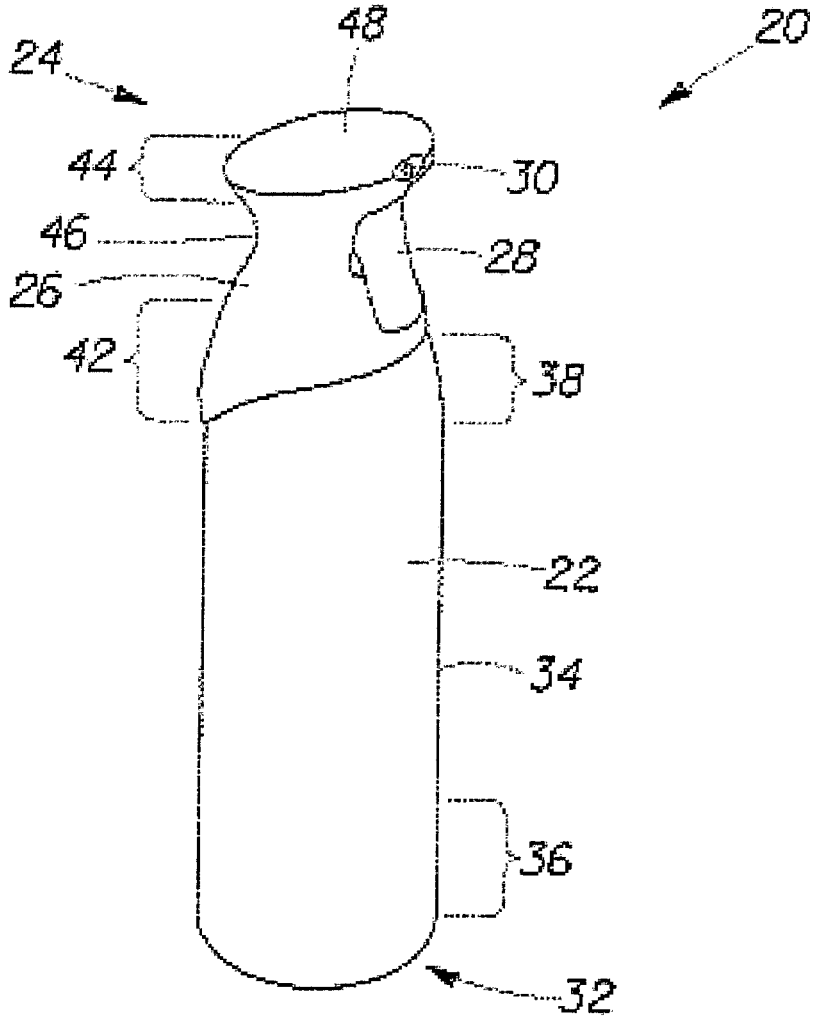
FIG. 7 is a perspective view of a sprayer.

With reference to FIGS. 1 and 7, the container 22 can be any suitable type of container for holding a product to be dispensed by the sprayer. The container 22 may be of any suitable shape. The container 22 has a base 32, sides 34, a lower portion 36, an upper portion 38, and a top 40. The container 22 may be generally cylindrical, but the sides 34 of the container may taper inwardly with a slightly convex curvature on the upper portion 38 of the container. The container 22 is, thus, narrower at its upper portion 38. With reference to FIG. 1, the container 22 may have a base 32, lower portion 36, or sides 34 that are larger (e.g., wider, larger volume, etc.) than the upper portion 38 and/or top 40. The container 22 can have numerous other shapes in different configurations. The container may comprise various materials, including, plastic, metal, glass, the like, and combinations thereof. A single spray actuator 24 can be utilized with various sizes and designs of containers 22.

The container 22 can contain any suitable composition that is capable of being sprayed by the sprayer 20. The composition can be in any suitable form, including liquid compositions, liquid to foam compositions, gel compositions, and other compositions. Examples of products include, but are not limited to: air freshening compositions, fabric freshening and/or cleaning compositions, hard surface cleaning compositions, ironing aids such as spray starches, insecticides, paints, cosmetic compositions, personal cleansing compositions, and other industrial, commercial, household, automotive, and/or garden compositions.

Figure 2:
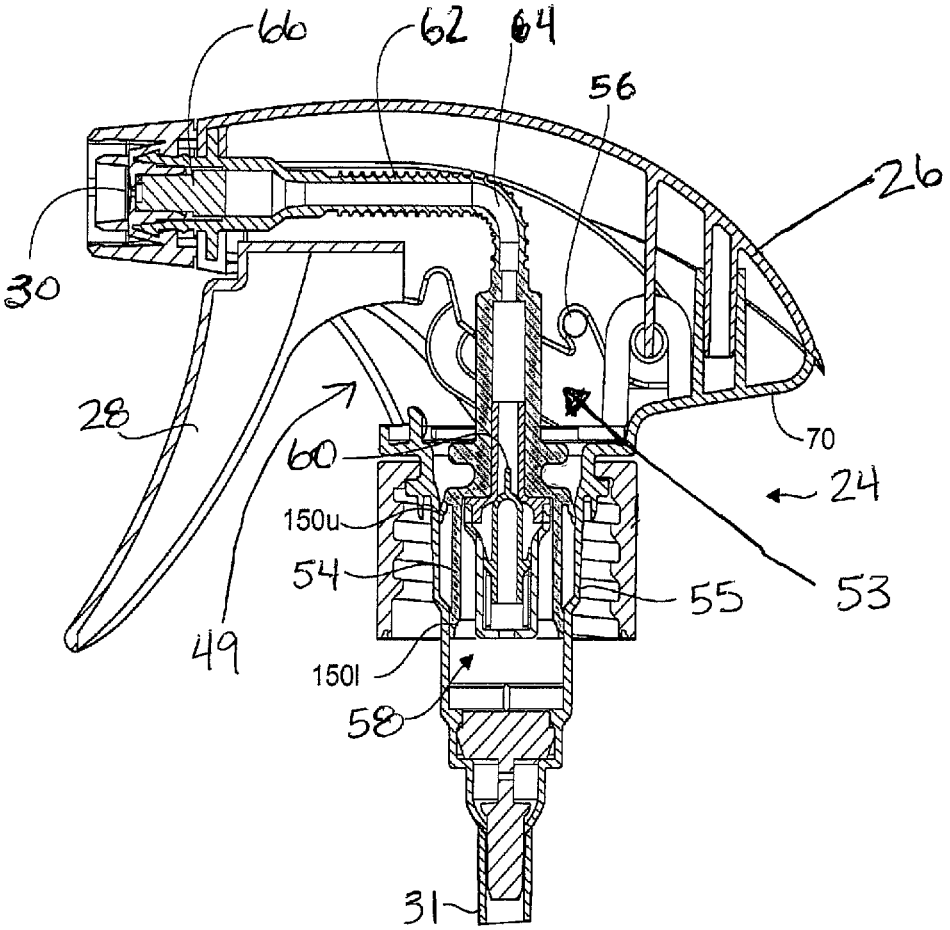
FIG. 2 is a sectional view of an actuator in a forward position of the sprayer of FIG. 1 taken along lines 2-2.

With reference to FIGS. 1 and 2, the sprayer may comprise a dip tube 31 that extends from the lower portion 36 of the container 22 to the spray actuator 24. The dip tube 31 may be in fluid communication with the composition contained within the container 22 at a first end portion and the spray actuator 24 at an opposite second end portion. The composition contained in the container 22 is drawn though the dip tube 31, in response to actuation by the trigger 28.

The actuator housing 26 may be configured in various different shapes and sizes. With reference to FIGS. 1, 2, 7, and 8, the actuator housing 26 may have a lower portion 42, an upper portion 44, a waist portion 46, and a top 48. The lower portion 42 fits on or over the container 22. The waist portion 46 may be disposed between the lower portion 42 and the upper portion 44. The waist portion 46 may be narrower than the widest portions of the upper and/or lower portions 44 and 42, respectively. The waist portion 46 and the lower portion 42 may each be narrower than the widest portions of the upper portion 44. The waist portion 46 provides the sprayer actuator 24 with an ergonomic design.

Figure 12:
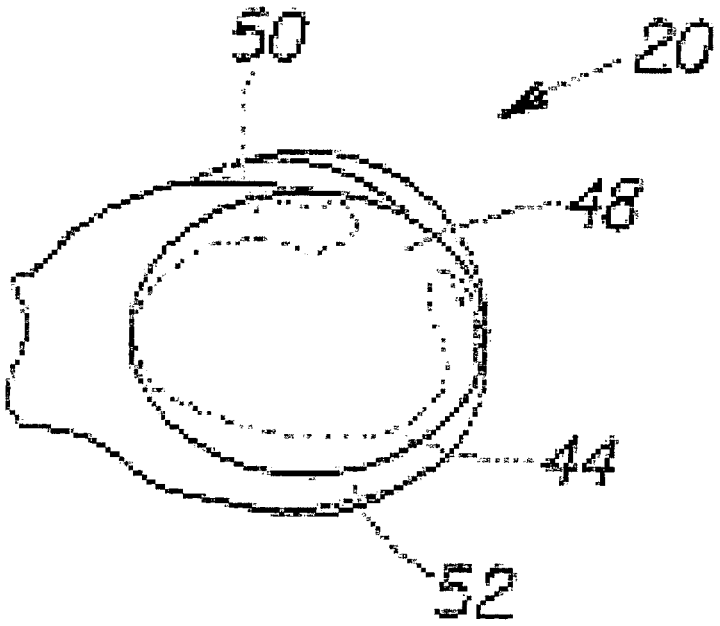
FIG. 12 is a top, plan view of the sprayer of FIG. 7.
Figure 13:
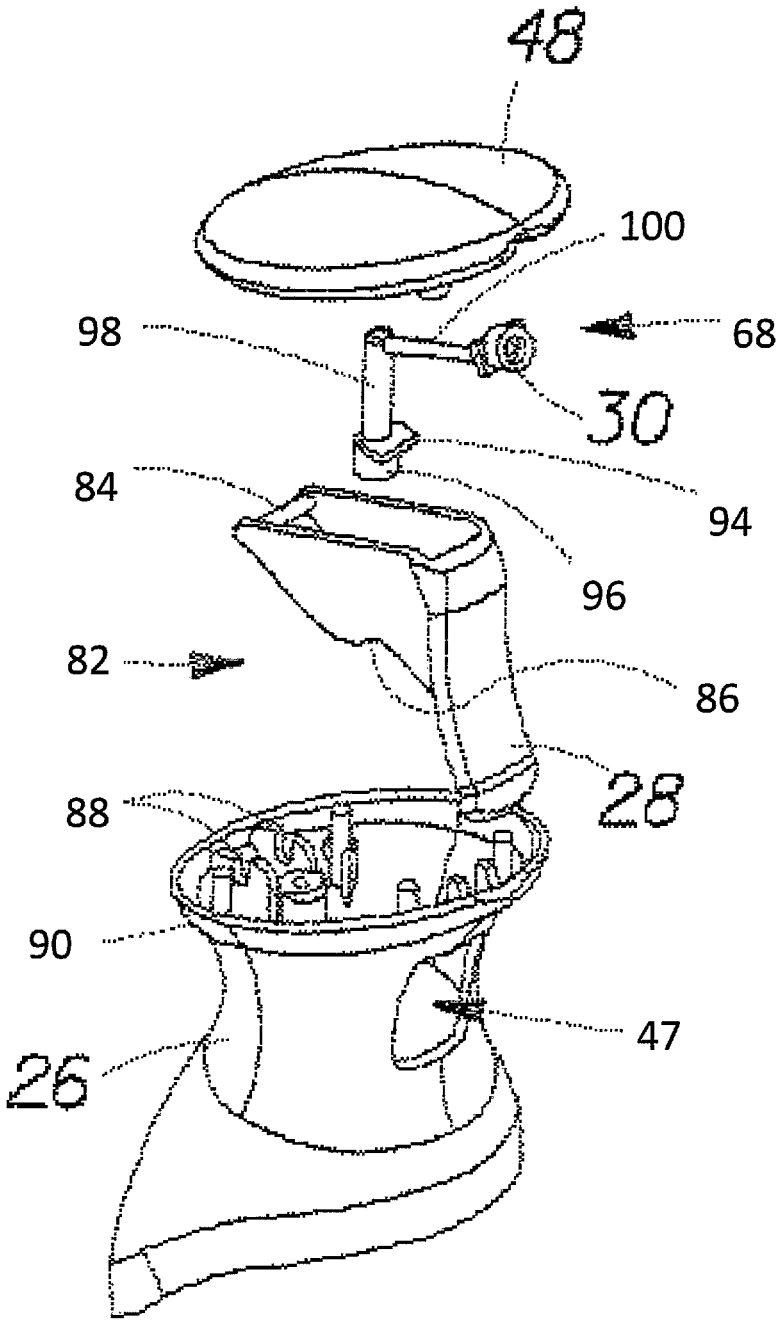
FIG. 13 is an exploded view of an actuator.

The actuator housing 26 may be configured so that a user can wrap at least their thumb 50 and forefinger 52 around the narrowed waist portion 46. In this embodiment, the sprayer actuator housing 26 is also provided with a configuration that permits it to comfortably fit the natural contour of the user's palm, such as in the crease in the user's palm. As shown in FIG. 12, when viewed from above, at least a part of the upper portion 44 extends outward beyond the portion of the user's thumb 50 and forefinger 52 that are in contact with the narrowed waist portion 46 to form a ledge.

Figure 11:
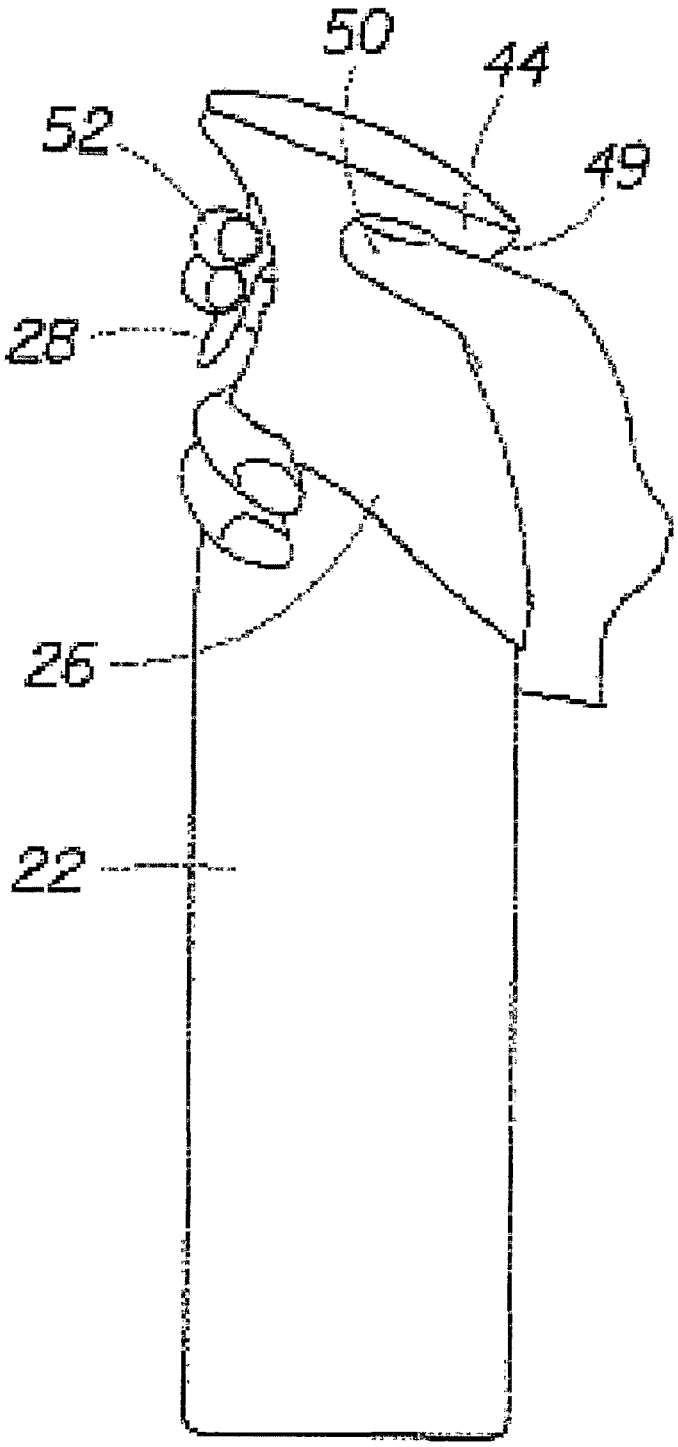
FIG. 11 is a side, elevation view of a sprayer, illustrating a user grasping the actuator.

With reference to FIGS. 1 and 11, having a narrow waist portion 46 may make the sprayer 20 easier to grip, especially for smaller hands. In addition, since the upper portion 44 comprises at least portions that are wider when viewed from above than the portion of the user's hand that at least partially encircles the waist portion 46, the ledge formed by these portions of the upper portion 44 can rest on a portion of the user's thumb and forefinger to at least partially support the weight of the sprayer 20 during use. This can relieve the pressure on the user's fingers and/or wrist, particularly when the sprayer 20 is used for a prolonged period.

The upper portion 44 may comprise portions at the front, sides, and rear of the sprayer that are wider than the portions of the user's hand that are in contact with the narrowed waist portion 46. The upper portion 44 need not have portions that are wider all the way around the sprayer than the portions of the user's hand that are in contact with the narrowed waist portion 46. Any suitable portion(s) of the upper portion 44 may extend laterally outward beyond the portions of the user's hand that are in contact with the narrowed waist portion 46. Such suitable portions include, but are not limited to on at least one of the sides, preferably both sides, and/or in the back of the sprayer.

The lower portion 42 of the actuator housing 26 may overlap the top 40 and/or sides 34 of the container 22. The lower portion 42 of the actuator 24 may be configured so that the outside surfaces of the sides 34 of the container 22 and the lower portion 42 of the actuator 24 are flush or form a substantially continuous surface. All parts of the lower portion 42 of the actuator housing 26 may be of uniform length. Or, the lower portion 42 of the actuator 24 may extend down further in the back of the sprayer 20 than in the front of the sprayer, with the front of the sprayer comprising the nozzle 30.

With reference to FIGS. 1 and 7-9, the upper portion 44 of the actuator housing 26 has a front, a back, and an underside 49. Portions of the actuator housing 26 may be angled upward from the back of the sprayer to the front of the sprayer comprising the nozzle 30. For example, one of or both of the underside 49 and the top 48 of the actuator housing 26 may be angled upward from the back of the sprayer to the front of the sprayer. The underside 49 of the upper portion 44 may be tilted so that the underside of said upper portion is higher in front than in the back to allow the sprayer to be held more ergonomically by a user without bending the user's wrist. The top 48 (and/or the underside 49) of the housing may have a different configuration (e.g., flat, tilted downward, etc.). It may even be possible to eliminate the top 48 of the housing 26 altogether.

The top 48 of the actuator housing 26 may be tilted upward because the sprayer nozzle 30 is oriented so that the composition sprayed from the nozzle 30 will be directed at an angle of greater than 0° and less than 90°. That is, the composition may not be sprayed out parallel to the base 32 (that is, horizontally when the base is placed on a horizontal surface), nor is it sprayed out vertically (straight upward in the direction of the axis of the container). The composition may be sprayed from the nozzle 30 at an angle of greater 0° and less than 90°.

Figure 8:
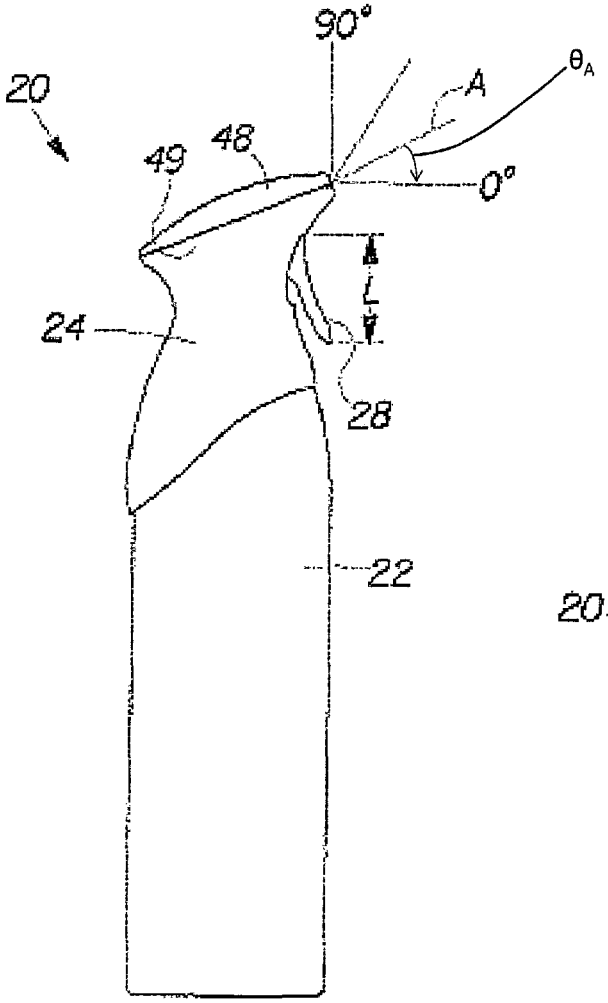
FIG. 8 is a side elevation view of the sprayer of FIG. 7.
Figure 9:
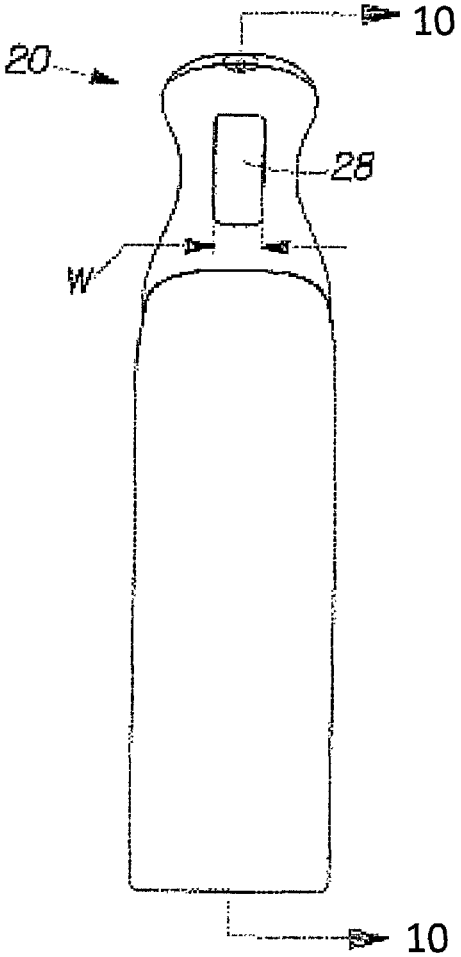
FIG. 9 is a front, elevation view of the sprayer of FIG. 7.

It may be desirable for the composition sprayed from the nozzle 30 to be sprayed horizontally (0°) or vertically (90°). In still other situations, such as in the case of an ironing aid, it may be desirable for the composition sprayed from the nozzle 30 to be directed downward toward a surface (at an angle of between 0° and −90°). It is appreciated, however, that spray patterns are typically in the form of dispersions, and the spray emitted from a nozzle will form a dispersed spray pattern angle when viewed from the side. The angles of spray referred to herein are the central axis, A, as shown in FIG. 8, that bisects such a spray pattern. It is understood that portions of the spray pattern will typically be distributed on either side of this central axis.

With reference to FIGS. 1, 2, 7, and 8, the actuator 24 can be removably affixed to the container 22 in any manner known in the art for removably affixing an article to a container, including but not limited to by screw threads, bayonet fitments, and by a snap fit. The actuator 24 can be permanently affixed to the container 22, or the actuator 24 can be removably affixed to the container 22.

The actuator housing 26 may include an opening 47 for the trigger 28 to extend therethrough.

The spray actuator 24 may be configured as a manually-activated trigger spray actuator or as an aerosol spray actuator. It is to be appreciated that components of the spray actuator, whether configured as a manually-activated spray actuator or an aerosol spray actuator, may be the same or similarly designed.

Referring to FIGS. 1-6 the spray actuator 24 may be configured as a manually-activated trigger spray actuator. A manually-activated spray actuator 24 comprises a pump assembly 53. Manual actuation of the trigger 28 through its stroke causes corresponding vertical movement of a piston 54 of the pump assembly 53. Vertical movement of the piston 54 pumps the composition from the container 22 through a flow path and out the nozzle 30. The piston 54 may move in a reciprocating motion within a pump body 55. The sprayer 20 may utilize an articulating, top-pivoting trigger 28.

In either a manually operated trigger sprayer or an aerosol sprayer, a return spring 56 provides bias to force the trigger 28 away from the container 22 and to the forward position ("forward motion") at the end of the stroke. The return spring(s) 56 may be configured as two curved parallel springs 56. The return springs 56 may be connected at each end and may be disposed outside the piston 54/fluid chamber 58. The vertically upwards flow path for the composition may be disposed between the return springs 56.

In a manually operated trigger sprayer, squeezing of the trigger 28 toward the container ("rearward motion") creates hydraulic pressure in a fluid chamber 58, causing the composition to be dispensed. Forward motion of the trigger 28 creates a vacuum, drawing the composition from the container 22 to refill the fluid chamber 58.

Figure 3:
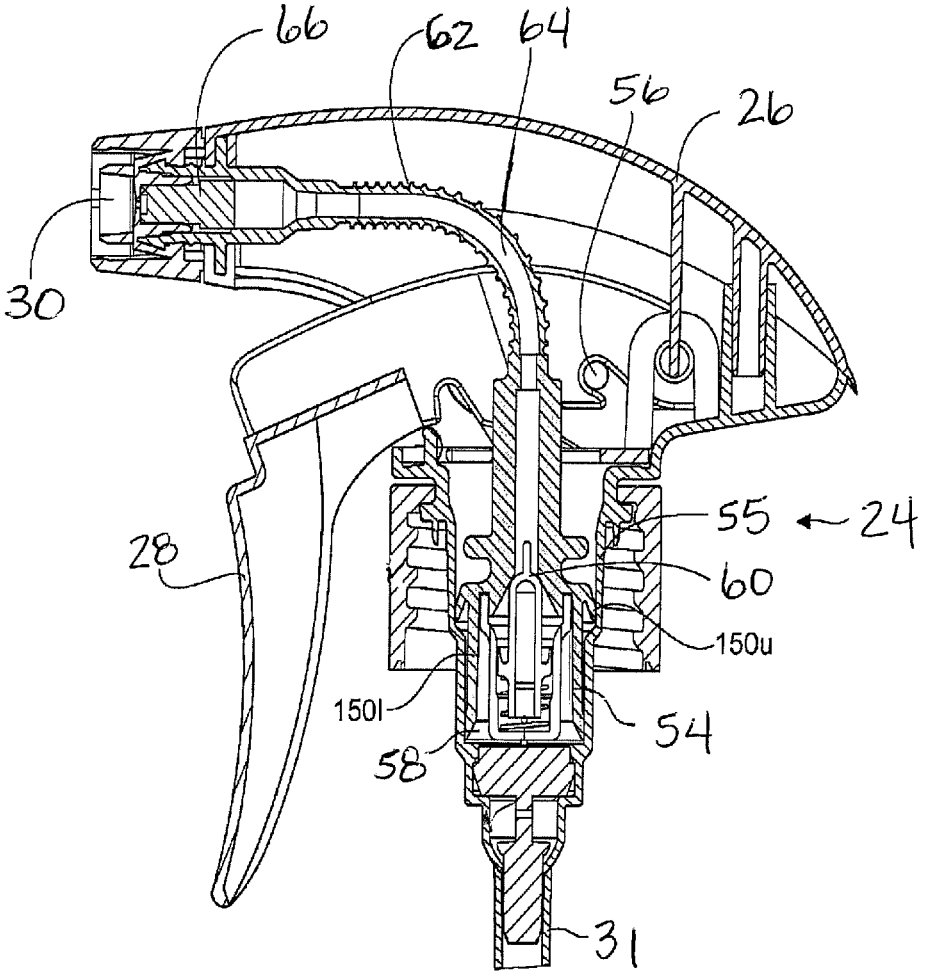
FIG. 3 is a sectional view of an actuator n a rearward position.

Referring to FIG. 3, once the fluid chamber 58 has been primed, rearward motion of the trigger 28 is converted to downward motion of the piston 54 within pump body 55. Downward motion of the piston 54 pressurizes the fluid chamber 58. Resistive forces within the system are overcome once the pressure in the fluid chamber 58 reaches a predetermined level, causing the valve 60 to open and the composition to flow through a conduit 62 and out the nozzle 30. The return spring 56 automatically alternates the trigger 28 to the forward rest position and the fluid chamber 58 is refilled with composition.

Figure 4:
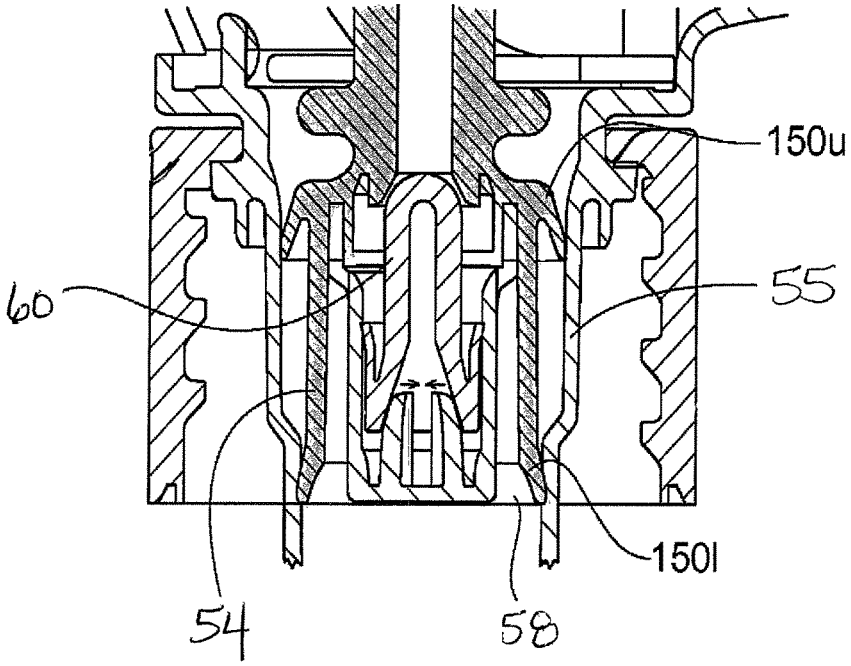
FIG. 4 is a fragmentary vertical sectional view of the actuator of FIG. 2, showing the trigger in a rearward position.

Referring to FIG. 4, and examining the pump assembly 53 in more detail, the pump body 55 may have a stepped configuration and may house the reciprocating piston 54. The pump body 55 may be captured by a screw closure 50 of the lower portion 52 of the actuator 24. The screw closure 50 may be opened to access and replenish the composition in the container 22, as desired. While a screw closure 50 is shown in FIG. 4, it is to be appreciated that the closure may be configured as a different type of closure, such as a bayonet or snap fit.

With reference to FIGS. 2-4, the reciprocating piston 54 may have an upper seal 150U and a lower seal 150L, both of which fit within the body 48. The valve 60 disposed within the piston 54 may have vertical movement thereof resisted by a spring (not shown). As force from the trigger 28 motion increases the force applied to the piston 54 the valve 55 may move downwardly as the composition is pressurized in the chamber 44 to be later dispensed.

The conduit 62 may be configured in various ways. For example, with reference to FIG. 2, the conduit 62 may be flexible and bent at approximately 90 degrees. The flexible conduit 62 bends at the elbow 64 in response to movement of the trigger 28/crank rocker, slightly increasing the angle at the elbow 65. The portion of the conduit 62 downstream of the elbow 64 bend terminates at a spinner 66.

Composition flowing through the conduit 62 passes through the spinner 66. The spinner 66 imparts a tangential rotation to the composition before the composition reaches the nozzle 30. The spinner 66 is inserted into the nozzle 30, up to the shoulder of the spinner 66. The spinner 66 and nozzle 30 are stationary. The spinner 66 may comprise a constant diameter pin with two longitudinal grooves disposed 180 degrees out on the downstream half of the axial length. The grooves terminate in a swirl chamber. The swirl chamber is disposed on the face of the spinner 66.

The spinner 66 may have two longitudinally opposed ends, an upstream end into which the aforementioned bent conduit 62 is fitted and a downstream end which fits into the nozzle 30. The spinner 66 may have a length of about 11 mm and a stepped diameter of about 4-5 mm. The spinner 66 may have two longitudinally oriented slots equally circumferentially spaced around the downstream portion thereof.

Upon exiting the spinner 66 the composition passes through the nozzle 30 for dispensing into the atmosphere or onto a target surface. The nozzle 30 may have a diameter of about 0.5 millimeters ("mm") to about 6 mm, and may be radiused on the outside face. The composition is dispensed from the nozzle 30 in a predetermined spray pattern, which may vary according with the stroke speed, stroke length, etc. of the trigger 28 operation. Optionally, provision may be made for adjusting the spray pattern.

The entire pump assembly 53 may be encased in the housing 70. There may be no direct opening from the pump assembly 53 to the outside of the housing 70, except for the nozzle 30.

Figure 5:
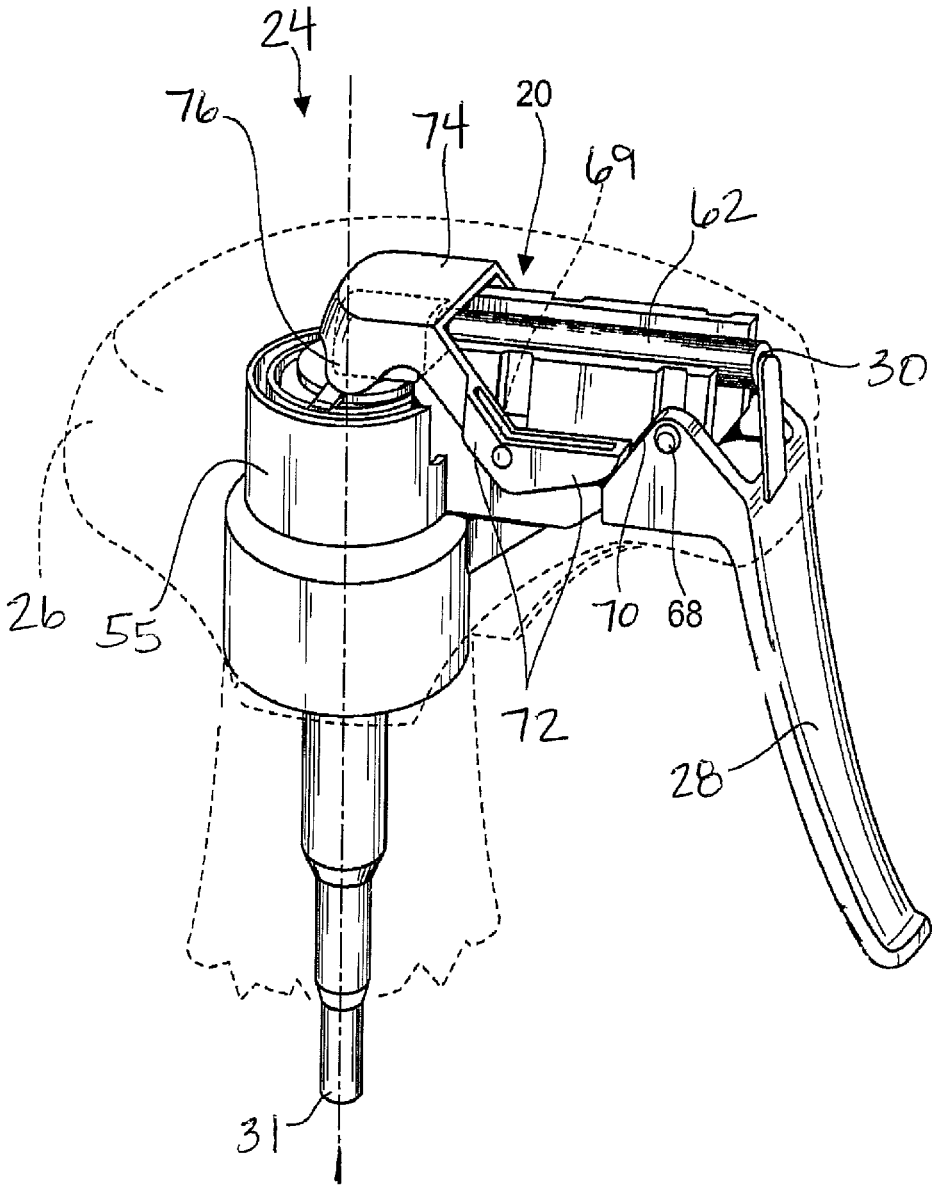
FIG. 5 is a perspective view of an actuator, showing the engine housing in phantom.
Figure 6:
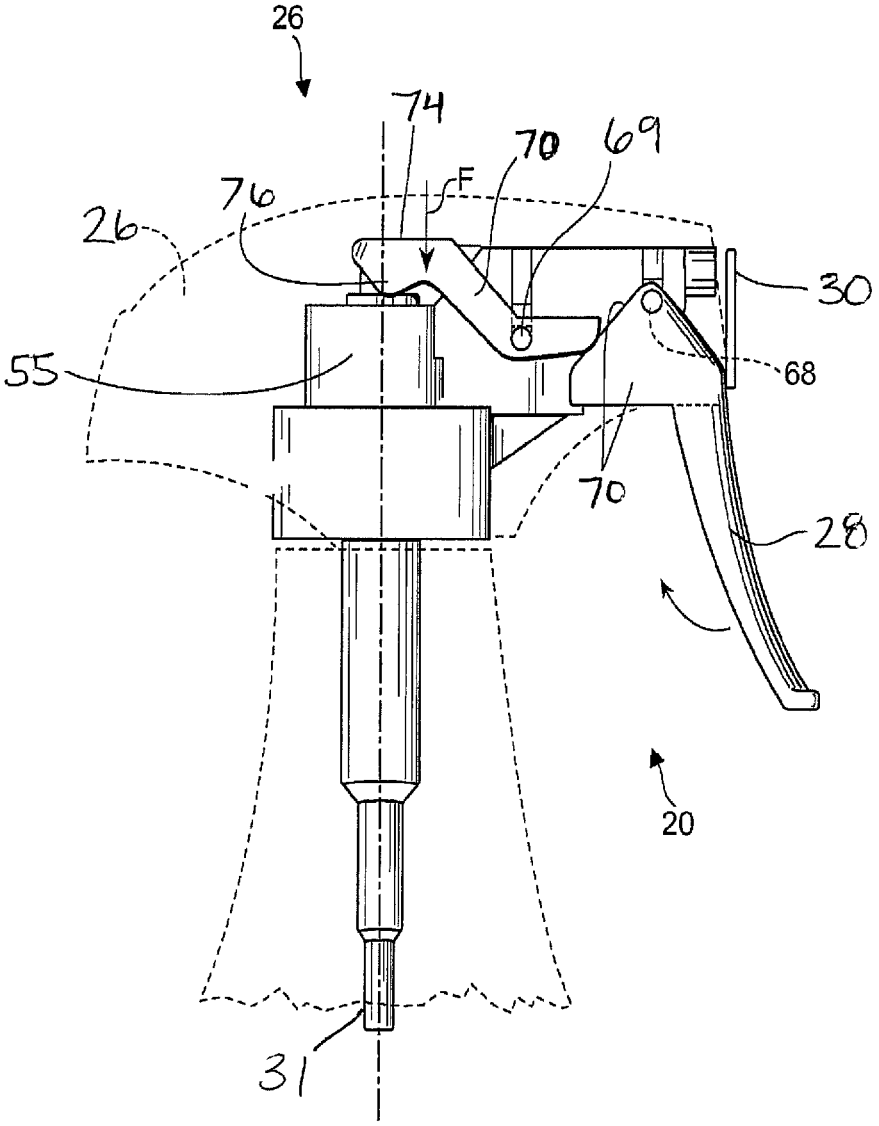
FIG. 6 is a side elevation view of FIG. 5.

Referring to FIGS. 5-6, the trigger 28 may be configured to provide travel which is more perpendicularly/radially oriented relative to the longitudinal axis than the geometry shown in FIGS. 2-3. This travel orientation may be accomplished by providing mounting trunnions 68 disposed near the uppermost portion of the trigger 28. A rearward-facing protrusion 70 on the trigger 28 may pivot upwardly against a rocker arm 72 of an articulable crank rocker 74. The rocker arm 72 is mounted on two trunnions 69. The opposite end 76 of the crank rocker 74 articulates downwardly, to provide a force F aligned with or coincident the longitudinal axis. This force F displaces the piston 54 in the downward direction, pressurizing composition in the fluid chamber 58. Referring back to FIG. 4, composition in the lower portion of fluid chamber 58 is displaced by the piston 54, flows upwardly through the annular portion of fluid chamber 58, past valve 60 and into conduit 62.

An actuator 24 such as shown in FIGS. 2-3 provides the advantage of fewer parts than the actuator 24 of FIGS. 5-6. An actuator 24 such as shown in FIGS. 5-6 may be utilized when a more horizontal trigger 28 motion is desired, providing desirable ergonomics.

In a manually-actuated trigger sprayer, the pump assembly 53 may be configured as a pre-compression pump assembly as known to one of ordinary skill in the art.

Referring to FIGS. 7-13, the spray actuator 24 may be configured for an aerosol sprayer 20. The trigger 28 may be part of a larger trigger piece 82, and the rear of the trigger piece 82 has a bar 84 joined thereto, or integrally formed therewith. The trigger piece 82 also comprises a bearing portion 86. The bar 84 is configured to fit into recesses or slots 88 in shelves 90 that are located on the inside of the actuator housing 26, at the rear portion thereof. This allows the trigger piece 82 to rotate in a hinged fashion. The trigger 28, thus, extends from the front of the sprayer 20, and is operatively associated with the actuator housing 26. While the trigger piece 82 of FIGS. 7-13 is shown as part of an aerosol sprayer, it is to be appreciated that the trigger piece 82 may be adapted for use with a trigger 28 and pump assembly 53 of a manually-activated trigger sprayer 20.

Figure 10:
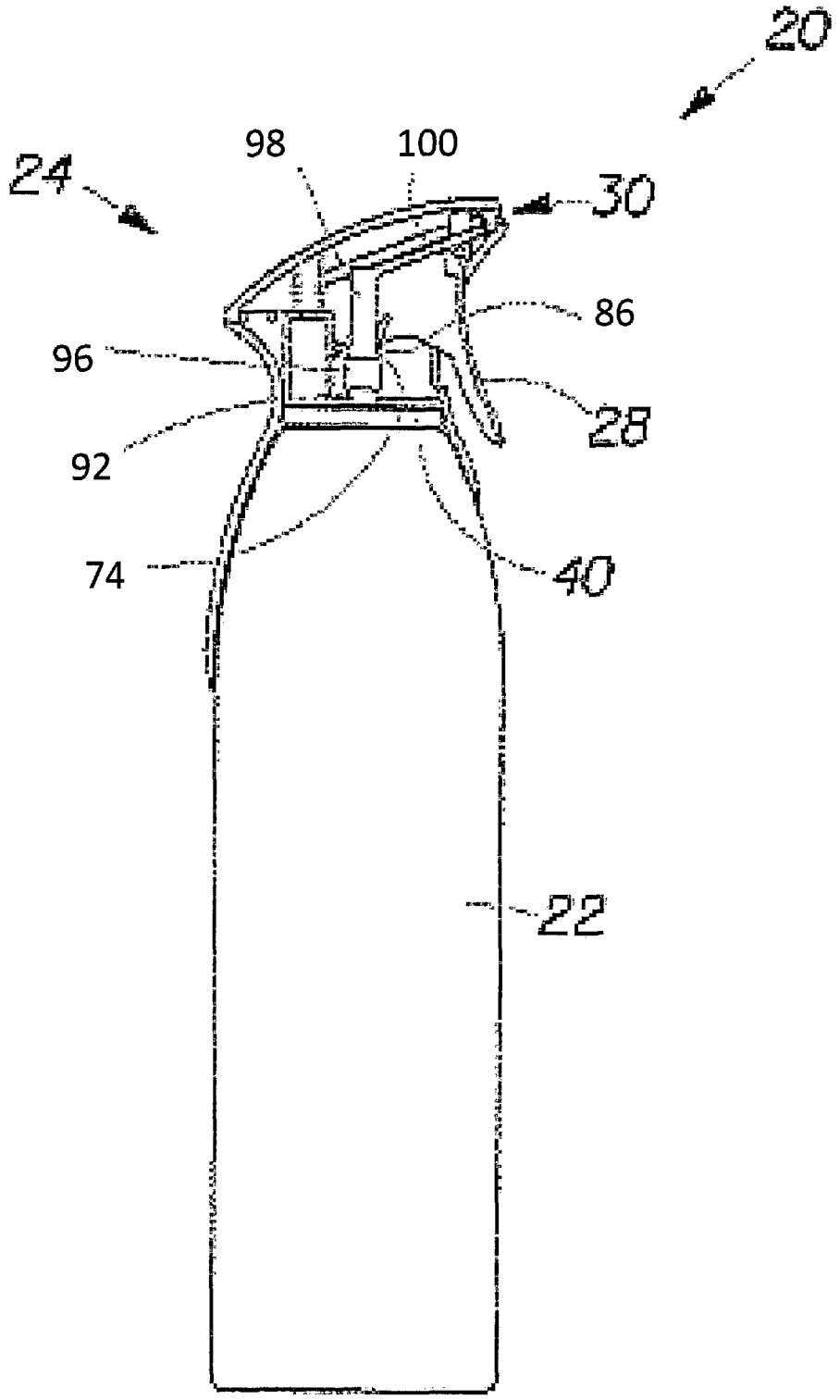
FIG. 10 is a sectional view of FIG. 9 taken along lines 10-10.

With reference to FIG. 10, in an aerosol sprayer, the container 22 may have a conventional valve stem 92 extending upward from the top 40 of the container. The sprayer actuator 24 further comprises a conduit 62. The conduit 62 has a first end and a second end. The conduit 62 is operatively connected with the nozzle 30 at the first end (or front) of the conduit 68. The conduit 68 may serve dual purposes of channeling the contents of the container 22 to the nozzle 30 where they can be sprayed out of the container 22, and also transmitting a downward force on the valve stem 92 to release the contents of the container 22.

In order to transmit a downward forward on the valve stem 92, the second, opposite end of the conduit 68 may be connected with a platform 94 and a cap 96. The conduit may comprise a first upstanding conduit portion 98 and a second angular conduit portion 100. The second conduit portion 100 forms an angle, $\theta_A$, with said first segment 72 greater than 0°. Where the sprayer is configured to direct the spray in at an upward angle relative to the base of the container 22, this angle $\theta_A$ is greater than about 90° and less than about 180°. The nozzle 30 may be held in a fixed location in the front of the actuator housing 26, and the cap portion 96 of the conduit 68 is fit over the valve stem 92 of the container 22. The first conduit portion 98 of the conduit 68 may be more rigid than the second conduit portion 100 (the latter is preferably flexible).

The sprayer actuator 24 may operate in the following manner. When a user pulls the trigger 28 inward toward the actuator housing 26 in a rearward motion, this causes the bearing portion 86 of the trigger piece 82 to press down on the platform 94 on the conduit 68. This causes the first conduit portion 98 of the conduit 68 to move downward and activates the valve stem 92 of the container. Since the nozzle 30 is in a fixed position, the flexible nature of the second conduit portion 100 of the conduit 68 may bend and permit the downward movement of the first conduit portion 98 to take place. The valve stem 92 permits the contents of the container 22 to be released. The contents of the container may flow through the conduit 68 and out the nozzle 30.

The conduit 62 need not comprise all of the elements described herein, and these elements can be provided as part of some other element of the sprayer actuator 24. The conduit 68 need not comprise a first and second conduit portion in which one of the conduit portions is flexible and one is more rigid. The entire conduit 68 may be flexible, or the entire conduit may be rigid. However, this may change the way that the sprayer actuator functions.

The nozzle 30 need not remain in a fixed position at the front of the actuator housing 26. For example, it is possible for the nozzle 30 to be mounted so that it moves upward and downward when the trigger 28 is moved.

The trigger piece 56 can comprise a portion of the actuator housing 26, or any other part of the actuator, rather than a separate component that is affixed to the actuator housing 26. Such a sprayer actuator need not comprise all of the features of the sprayer described herein.

In still other embodiments, the trigger piece 56 and the conduit 68 can be formed as a single integral component In an aerosol sprayer 20, the container 22 may also include a propellant for dispensing the composition disposed therein. Any suitable propellant may be used. Suitable propellants include, but are not limited to: hydrocarbon propellants such as: isobutene, butane, isopropane, dimethyl ether (DME), or non-hydrocarbon propellants such as compressed gases which include, but are not limited to compressed air, nitrogen, inert gases, carbon dioxide, and mixtures thereof; liquefied gas propellants; and soluble gas propellants. It may be desirable for the propellant to be substantially free of hydrocarbon propellants. A container configured to contain contents under pressure may be comprised of metal, plastic, the like, or combinations thereof.

The nozzle 30 may be configured to spray droplets of any suitable size. The nozzle 30 may be configured to spray a plurality of droplets wherein at least some of the spray droplets have a diameter in a range of from about 0.01 μm to about 500 μm, or from about 5 μm to about 400 μm, or from about 10 μm to about 200 μm. The mean particle size of the spray droplets may be in the range of from about 10 μm to about 100 μm, or from about 20 μm to about 60 μm. These size droplets may be useful in the case of air freshening compositions in which it is desired to suspend the droplets in the air for prolonged periods.

The particle size diameter is determined using a Spraytec 2000 particle size analyzer, using Malvern RT Sizer 3.03 software. Both are available from Malvern Instruments, Ltd, UK.

A 300 mm lens is used, having minimum and maximum particle size detections of 0.10 and 900.00 microns, respectively. The spray nozzle is positioned 140 mm from the laser beam, using a 100 mm path length. A particulate refractive index of 1.33 and dispersant refractive index of 1.00 are selected. A residual of 0.41 is selected, with the extinction analysis Off and multiple scatter set to On. The Scatter start is set to 1, scatter end is set to 36, and scattering threshold is set to 1.

One of skill will consider the Dv(50) measurement, meaning that 50 percent of the particles have a mean particle diameter less than the value indicated. Likewise one of skill will consider the Dv(90) measurement, meaning that 90 percent of the particles have a mean particle diameter less than the value indicated.

One of skill may also consider the D[4,3] measurement. This measurement sums the individual particle diameters raised to the $4^{th}$ power, divided by the sum of the individual particle diameters raised to the $3^{rd}$ power. This measurement is independent of the actual number of particles under consideration in the measurement.

One of ordinary skill may desire different particle size distributions of composition dispensed using the sprayer 20. If the particles are too large, the composition may simply fall onto the floor or form a wet spot, puddling on the target surface. If the particles are too small, they may not have enough surface area to be efficacious. For example, spray particles less than 50 microns in diameter may remain suspended indefinitely or until evaporation occurs.

With reference to FIGS. 14A-15B, the sprayer actuator comprises a trigger 28 operatively associated with the actuator housing at the front of the sprayer. The trigger 28 may be ergonomically designed. The trigger 28 may allow the user to use two or more fingers (such as their index and middle fingers) to activate the trigger 28. This reduces fatigue on the user's index finger in the case of prolonged spraying.

The trigger 28 may comprise two or more zones, such as a first zone 28*a* and a second zone 28*b* shown in FIGS. 14A-15B for a non-limiting, illustrative purpose only. Each zone may be configured such that a user can place one or more digits on each of the zones (28*a*, 28*b*, etc). For example, the user may be able to place two digits on the first zone 28*a* and two digits on the second zone 28*b*. Each zone (28*a*, 28*b*, etc.) may be operatively associated with the pump assembly such that the force applied by a user's digits to each of the zones contributes to the actuation of the piston 54.

The trigger 28 may be designed to be more ergonomic or compliant through a single stroke of the trigger 28. With reference to FIGS. 14A and 14B, each zone may be configured as a separate element that is joined together with adjacent zones of the trigger 28. Each adjacent zone 28*a*, 28*b* may be joined together by a hinge 104. Adjacent zones may be rotatable about a hinge axis, such as hinge axis B between the first and second zones 28*a* and 28*b*. With reference to FIGS. 15A and 15B, adjacent zones, such as first and second zones 28*a* and 28*b*, may be a unitary element and the hinge 104 may be configured as a living hinge.

The actuator 24 may include a mechanical stop 106 that is disposed in the travel path of one or more of the zones of the trigger. With reference to FIGS. 14A and 15A, the trigger 28 starts in the forward position where the first zone 28*a* is disposed away from the mechanical stop 106. As the trigger 28 is actuated and moved toward a rearward position, the entire trigger 28 rotates about axis A. With reference to FIGS. 14B and 15B, once the first zone 28*a* contacts the mechanical stop 106, the mechanical stop 106 applies a force to the first zone 28*a* of the trigger, causing the first and second zones 28*a* and 28*b* to rotate about hinge axis B in opposite directions. As a result of motion of the zones about hinge axis B, the first zone 28*a* becomes disengaged from the motion of the second zone 28*b* of the trigger about axis A. The second zone 28*b* may continue rotating about axis A as the user continues actuating the trigger toward the rearward position.

By disengaging the motion of the first zone 28*a* of the trigger, the user may be able to operate the trigger 28 in an ergonomic fashion. Particularly, the user is able to disengage what may be their weaker digits (e.g., the pinky and ring finger) and continue actuating the trigger through the full trigger stroke with their stronger digits. Further, by disengaging one or more of the lower zones of the trigger through a mechanical stop(s), the moment arm of the trigger 28 changes throughout the rearward motion stroke. The weaker digits may no longer be needed as the trigger 28 nears the rearward position of the stroke because the stronger digits may have a better grip on the trigger the closer the trigger is to the actuator housing 26 and/or container 22.

With reference to FIG. 14*a*, one or more of the zones may include an extension, such as extension 108 on the first zone 28*a* of the trigger 28. The extension 108 may extend from one or more of the zones and may overlap with an adjacent zone. In a configuration whether the zones of the trigger are separate elements connected at a hinge, the extension 108 may provide the benefit of locking adjacent zones together during the forward motion of the trigger back to the forward position. With reference to FIG. 15*a*, in a configuration whether zones are joined by a living hinge 104, an extension may not be needed.

Figure 17:
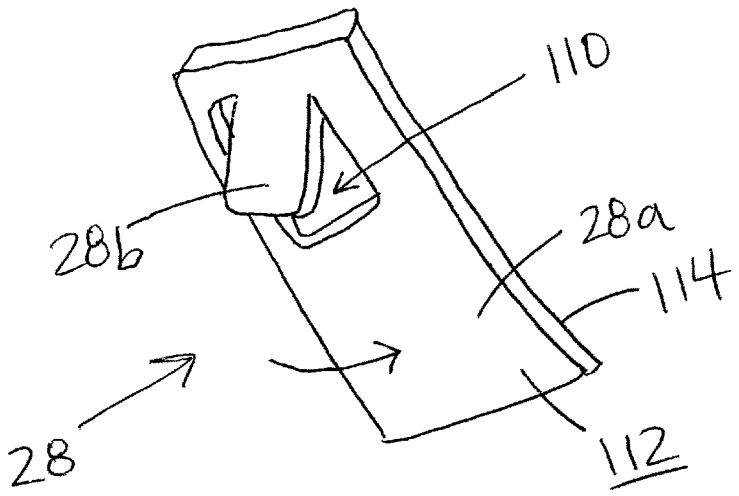
FIG. 17 is a schematic of a perspective view of a trigger in a rearward position.

The trigger 28 may have a changing moment arm throughout a stroke to provide a dynamic ergonomic grip for a user. With reference to FIGS. 16 and 17, in order to achieve a changing moment arm, the trigger 28 may be comprised of an elastomeric material. The trigger 28 may comprise at least two zones, such as a first zone 28*a* and a second zone 28*b*. The zones (28*a*, 28*b*, etc.) may consist of a single element, where a portion of the element is removed, leaving an opening that enables the second zone 28*b* to move relative to the first zone 28*a*. With reference to FIG. 16, in a non-actuated forward position, the first and second zones 28*a* and 28*b* may be aligned. With reference to FIG. 17, a user may actuate the first zone 28*a*, causing the first zone 28*a* to flex as the first zone 28*a* moves from a forward position in a rearward motion to a rearward position. While the first zone 28*a* is actuated in a rearward motion, the second zone 28*b* may remain in a forward position until the trigger 28 begins to flex adjacent to the second zone 28*b*, causing the second zone 28*b* to begin moving in a rearward motion toward the rearward position. As discussed above, by changing the moment arm over a single stroke, a user's weaker digits are not needed as the trigger 28 nears the rearward position of the stroke because the stronger digits may have a better grip on the trigger the closer the trigger is to the actuator housing 26 and/or container 22. Separating the trigger 28 into a plurality of zones, such as the first and second zones 28*a* and 28*b* of FIG. 17, the spray duration for a single stroke may be extended beyond the duration of a standard stroke.

Figure 18:
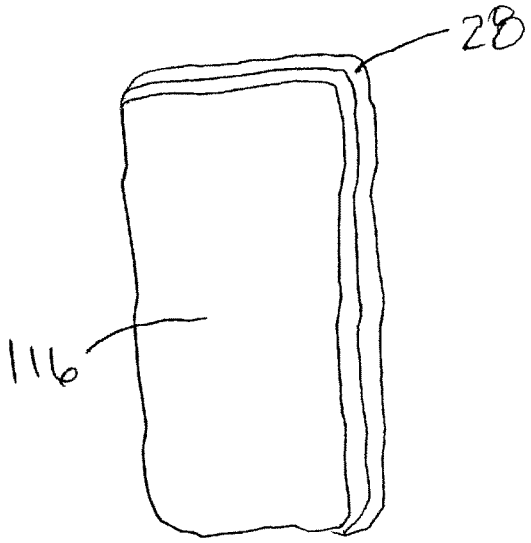
FIG. 18 is a schematic of a front, elevation view of a trigger.

With reference to FIGS. 16-18, a front surface 112 or back surface 114 of the trigger 28, including all zones of the trigger, may be covered by an additional flexible material 116 such that a user only sees a single surface and is unable to see the opening 110 between the first and second zones 28*a* and 28*b*.

Figures 19, 20:
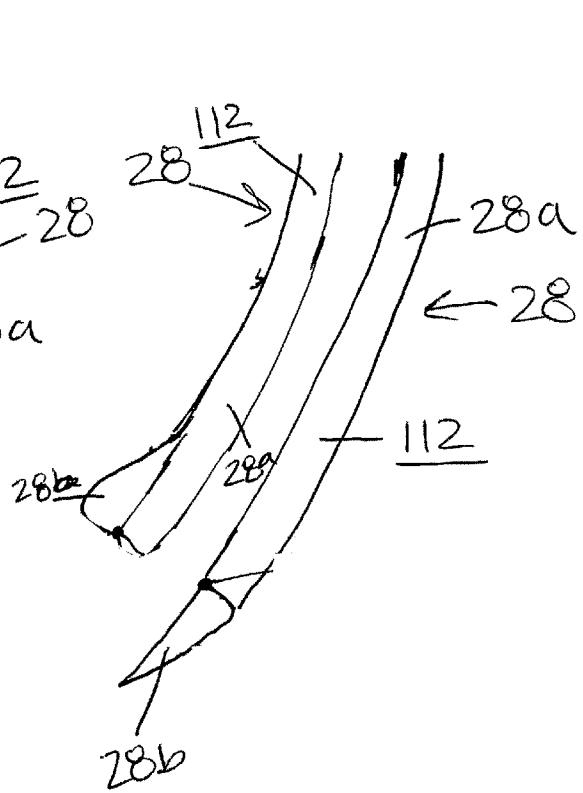
FIG. 19 is a schematic of a perspective view of a trigger.
FIG. 20 is a schematic of a perspective view of a trigger.

A trigger may also be configured for a user to select a desired moment arm length. For example, with reference to FIGS. 19 and 29, the trigger 28 comprises at least two zones, such as a first zone 28*a* and a second zone 28*b* and a front surface 112. The trigger 28 may be adaptable in at least two configurations. In a first configuration, the front surface 112 may have a first length $L_1$. The first length $L_1$ of the outer surface 112 comprises the length of the first zone 28*a* and the second zone 28*b* is disposed on the back surface 114 of the trigger 28, overlapping with the first zone 28*a*. In a second configuration, the outer surface 112 of the trigger 28 may have a second length $L_2$ that is different from the first length $L_1$. The second length $L_2$ comprises the length of the first and second zones combined as the second zone 28*b* extends from the first zone 28*a*. The trigger 28 may also be adaptable to more than two configurations, wherein in each configuration the front surface 112 is adjustable to a different length. In order to achieve additional configurations, the trigger 28 may have more than two zones. The zones (28*a*, 28*b*, etc.)

may be rotatably or slideably connected. If the first and second zones 28*a* and 28*b* are slideably connected, the trigger may comprise a latch or bump stop that locked the second zone at a predetermined position when the second zone forms a portion of the outer surface 112.

The zones (28*a*, 28*b*, etc.) of the trigger 28 may be similarly sized or one zone may be larger than the others. The zones of the trigger 28 may be composed of the same or different materials.

With reference to FIGS. 14A-18, it is to be appreciated that any trigger 28 of the present disclosure may further comprise a cover. The cover may be used to at least partially surround the trigger such a shown in FIG. 18 so that a user is unable to see the delineation between the multiple zones of the trigger, and, instead sees and feels a continuous surface. The cover 78 may conform to the shape of the first and second zones 28*a* and 28*b* of the trigger 28 is stationary and/or while the trigger is actuated. The cover 78 may form a continuous surface that is more ergonomic and/or more aesthetically pleasing for a user than the exposed surfaces of the first and second zones 28*a* and 28*b* of the trigger 28. The cover 78 may be composed of an elastomer, such as silicone rubber, for example. However, various other materials may be used for the cover 78.

During the rearward motion of the first zone 28*a*, the second zone 28*b* of the trigger may remain stationary and energy transfers to the energy storing coupling 80. Then, if the user continues to hold the trigger 28 in the depressed state, the energy storing coupling 80 releases the stored energy by forcing the second zone 28*b* of the trigger 28 in a rearward motion. The rearward motion of the second zone 28*b* causes the energy releasing piston to continue moving in the rearward direction. As a result, the user will experience an extended spray of the composition out of the nozzle 30 even though the first zone 28*a* of the trigger 28 is fully depressed and the user will have applied a lower, more ergonomic force to achieve such a spray. It is to be appreciated that the same quantity of composition may be dispensed from the sprayer having an energy storing coupling 80, however, the energy storing coupling 80 may result in an extended duration of spray.

The energy storing coupling 80 may be selected from the group consisting of: a torsion spring, a coil spring, a leaf spring, an elastomeric material, and combinations thereof.

The trigger 28 can have any suitable dimensions. The trigger may have a length, L, of greater than or equal to about 1.25 inches (about 30 or 32 mm). The trigger 28 may have a width, W, of greater than or equal to about 7/16 inch (about 10 or 11 mm). For example, the trigger 28 may have a width of about 10/16 inch (about 15 or 16 mm). The trigger 28 may not be ergonomically designed, and can be of a more conventional design and size.

The trigger sprayer 20 described and claimed herein is suitable for use with compositions having certain rheological properties ranging from those of distilled water to those of an air/fabric refreshing compositions. Particularly, the compositions suitable for use with the present disclosure may have a dynamic viscosity ranging from about 0.85 to about 1.1 centipoises at 25 degrees C. and a kinematic viscosity ranging from about 8.9 E-4 to about 0.001 Pascal*seconds. The compositions may have a surface tension ranging from about 20 to about 75 milliNewtons/meter at 25 degrees C.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An actuator comprising:

a nozzle;

a piston;

a trigger operatively connected with the valve, wherein the trigger comprises a first zone and a second zone, wherein the first and second zones are joined by a hinge, wherein the hinge comprises a hinge axis that the first and second zones are movable about, wherein the trigger is configured to reciprocate from a forward position to a rearward position and back to a forward position upon actuation, wherein reciprocation of the trigger causes corresponding reciprocation of the piston, the reciprocation of the piston being able to draw a liquid from a reservoir, and discharging a liquid through the nozzle; and a mechanical stop, wherein the mechanical stop is configured to engage with the first zone of the trigger, wherein movement of the trigger from a forward position to the mechanical stop causes the first and second zones to move about a common axis, wherein movement of the trigger from the mechanical stop to the rearward position causes the first and second zones to move in opposite directions about the hinge axis.

2. The actuator of claim 1, wherein the hinge is a living hinge.

3. The actuator of claim 1, wherein the first and second zones are separate elements connected at the hinge.

4. A sprayer comprising the actuator of claim 1 that is operatively connected with a container.

5. The sprayer of claim 4 further comprising an air freshening composition or a fabric freshening composition.

6. A method of freshening the air or fabric comprising the steps of:

providing a sprayer of claim 1;

spraying the composition into the air or onto a surface.

7. An actuator comprising:

a nozzle;

a valve;

a trigger operatively connected with the valve, wherein the trigger comprises a first zone and a second zone, wherein the first and second zones are connected at a hinge, wherein the trigger is configured to reciprocate from a forward position to a rearward position and back to a forward position upon actuation, wherein applying a force to the hinge in the opposite direction of actuation causes the first and second zones to move in opposite directions about the same axis.

8. The actuator of claim 7, wherein the hinge is a living hinge.

9. The actuator of claim 7, wherein the first and second zones are separate elements connected at the hinge.

10. The actuator of claim 7, wherein the trigger comprises a cover, wherein the cover comprises an elastomeric material that surrounds the first and second zones of the trigger.

11. The actuator of claim 7, wherein the trigger comprises an elastic coupler that joins the first and second zones.

12. A sprayer comprising the actuator of claim 7 that is operatively connected with a container.

13. The sprayer of claim 12 further comprising an air freshening composition or a fabric freshening composition.

14. A method of freshening the air or fabric comprising the steps of:

providing a sprayer of claim 7;

spraying the composition into the air or onto a surface.

* * * * *